US005105888A

United States Patent [19]

Pollock et al.

[11] Patent Number: 5,105,888

[45] Date of Patent: Apr. 21, 1992

[54] WELL CASING HANGER AND PACKOFF RUNNING AND RETRIEVAL TOOL

[76] Inventors: J. Roark Pollock, 11118 Middleburg, Tomball, Tex. 77375; William A. Valka, 22802 Canyon Lake, Spring, Tex. 77373

[21] Appl. No.: 683,003

[22] Filed: Apr. 10, 1991

[51] Int. Cl.[5] ..... E21B 33/043

[52] U.S. Cl. ..... 166/348; 166/208; 285/86; 285/141

[58] Field of Search ..... 166/78, 85, 86, 87, 166/182, 208, 319, 348, 360, 368, 382

[56] References Cited

U.S. PATENT DOCUMENTS

| | | | |
|---|---|---|---|
| 3,688,841 | 9/1972 | Baugh | 166/85 |
| 3,837,684 | 9/1974 | Hynes | 166/87 X |
| 4,880,061 | 11/1989 | Ahlstone | 166/348 |
| 4,881,784 | 3/1989 | Theiss | 166/208 |
| 4,969,516 | 11/1990 | Henderson et al. | 166/368 X |
| 4,969,519 | 11/1990 | Kelly | 166/348 |
| 5,044,442 | 9/1991 | Nobileau | 166/182 X |

*Primary Examiner*—Ramon S. Britts
*Assistant Examiner*—Frank S. Tsay
*Attorney, Agent, or Firm*—W. William Ritt, Jr.; Richard B. Megley

[57] ABSTRACT

A running tool for lowering, landing and setting a well structure, such as casing hanger and a packoff has an elongated tubular body in which are mounted a plurality of locking dogs that releasably lock a casing hanger to the tool, a plurality of packoff running pins for releasably locking a packoff to the tool, and a plurality of packoff retrieval pins to engage a packoff in a wellhead housing and secure it to the tool for retrieval from the housing. The locking dogs are cammed radially from the tool body into their hanger engaging position by an actuator sleeve, and the running pins and retrieval pins are spring-biased in a radial direction towards their packoff engaging positions and releasably held in their retracted positions by retraction shafts in the tool body. The running tool can be used to (1) run, land and set both a casing hanger and it packoff in a subsea wellhead housing during a single trip to the wellhead and perform a blowout preventer test, (2) run, land and set the hanger and the packoff individually by separate trip, and (3) retrieve the packoff from the wellhead by a single trip.

10 Claims, 6 Drawing Sheets

WELL CASING HANGER AND PACKOFF RUNNING AND RETRIEVAL TOOL

BACKGROUND OF THE INVENTION

This invention relates to well drilling and completion equipment, and more particularly to well tools for running casing hangers and packoffs into, and for retrieving the packoffs from, subsea wellheads.

During the course of drilling subsea or other underwater wells considerable time is spent in running, landing and setting the casing and casing hangers in the submerged wellhead housing, and then retrieving the running pipe string and the running tool attached thereto for subsequent reuse. To reduce this costly time factor a substantial number of running tools have been designed and tested with varying degrees of success, but the industry is still in need of improvements over these prior devices.

SUMMARY OF THE INVENTION

The present invention provides an improved multifunctional cam-actuated casing hanger/packoff running tool that can be used to (1) run, land and set both a casing hanger and its packoff in a subsea wellhead housing during a single trip to the wellhead and perform a blowout preventer (BOP) test on the packoff once it is set, (2) run, land and set the hanger and packoff individually by separate trips, and (3) retrieve the packoff from the wellhead by a single trip. A running tool according to this invention includes an elongated tubular body in which are mounted a plurality of locking dogs that releasably lock a casing hanger to the tool, a plurality of packoff running pins for releasably locking a packoff to the tool, and a plurality of packoff retrieval pins to engage a packoff in a wellhead housing and secure it to the tool for retrieval from the housing. The locking dogs are cammed radially from the tool body into their hanger engaging position by an actuator sleeve that is moved longitudinally by rotation of a mandrel within the body, and the running pins and retrieval pins are spring-biased in a radial direction towards their packoff engaging positions and releasably held in their retracted positions by retraction shafts in the tool body. These shafts are designed for manual rotation by a wrench or other suitable implement at the surface prior to running the tool to the subsea wellhead so that the tool can be easily set up for either running or retrieving a packoff, as desired.

A casing hanger/packoff tool according to this invention involves a unique method of releasing from the packoff while ensuring that the packoff is locked in place in the wellhead housing. The tool's packoff running pins remain engaged with the packoff until it has been fully set and locked in place in the wellhead housing, and disengage for retrieval of the tool only when this has occurred. If setting and locking down of the packoff has not occurred the pins do not release whereby the packoff will be retrieved with the tool, thereby preventing improper installation of the packoff that would necessitate another trip into the well to connect onto and retrieve the packoff.

Another unique feature of a running tool according to this invention is that it moves as one piece when it unlocks from the hanger and drops down inside the hanger during lowering of the packoff into its functional position, thereby reducing the possibility of malfunction such as can occur with prior running tools which have concentric elements that telescope in a collapsing manner as the packoff is being set.

Yet another advantageous and unique feature of a running tool according to this invention is the way in which it supports the casing hanger during a BOP pressure test. Once the packoff is set the test is performed with the tool inside the hanger, thereby supporting and preventing inward circumferential deflection of the hanger that would result from the downward force exerted by the test procedure on the hanger to produce a large compressive hoop stress in the hanger.

Other novel features and advantages will become apparent from the following description of the preferred embodiment of this invention, read in conjunction with the accompanying drawings.

DESCRIPTION OF THE PREFERRED EMBODIMENT

Figure 1:
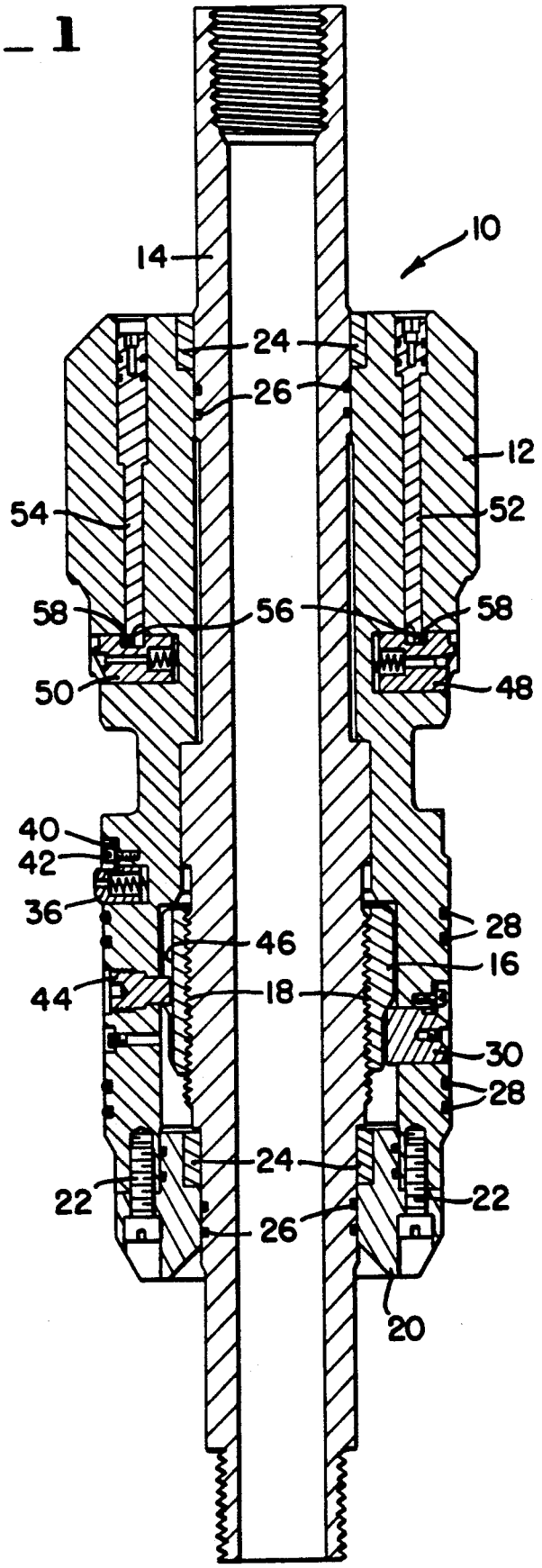
FIG. 1 is a vertical section through a running tool according to the present invention, taken along the line 1—1 of FIG. 2.
Figure 2:
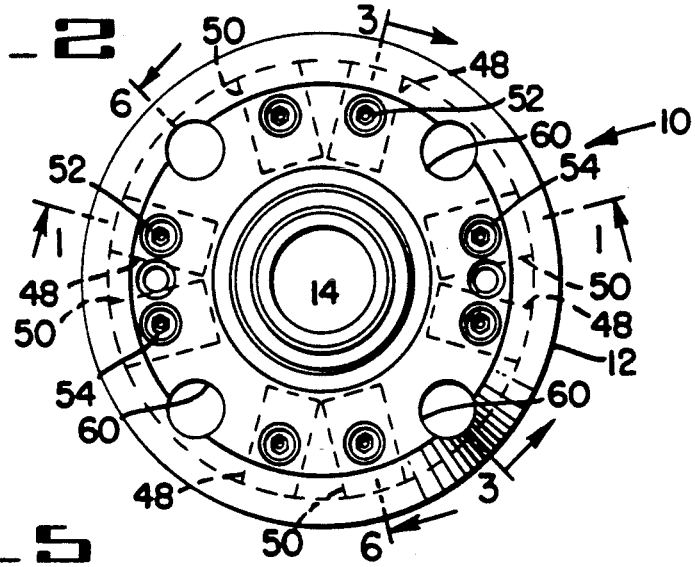
FIG. 2 is a plan view of the tool of FIG. 1.

As illustrated best in FIGS. 1 and 2, a casing hanger/packoff running/retrieving tool 10 according to the present invention comprises an assembly of an elongated tubular body 12, an elongated tubular mandrel 14 within the bore of the body 12, an actuation sleeve 16 surrounding and attached to the mandrel by threads 18, and a mandrel retaining ring 20 secured to the lower end of the body by a plurality of circumferentially-spaced cap screws 22. Upper and lower annular bushings 24, of bronze or other suitable material, provide dynamic bearing surfaces between the mandrel 14 and the body 12 and retaining ring 20, and O-rings 26 or other suitable annular seal elements provide pressure seals between the mandrel and the body and retaining ring. Surrounding the body 12 are a plurality of O-rings 28 that function to provide a pressure seal between the body and a casing hanger to which it may be connected, as seen in FIGS. 3 and 4.

Figure 3:
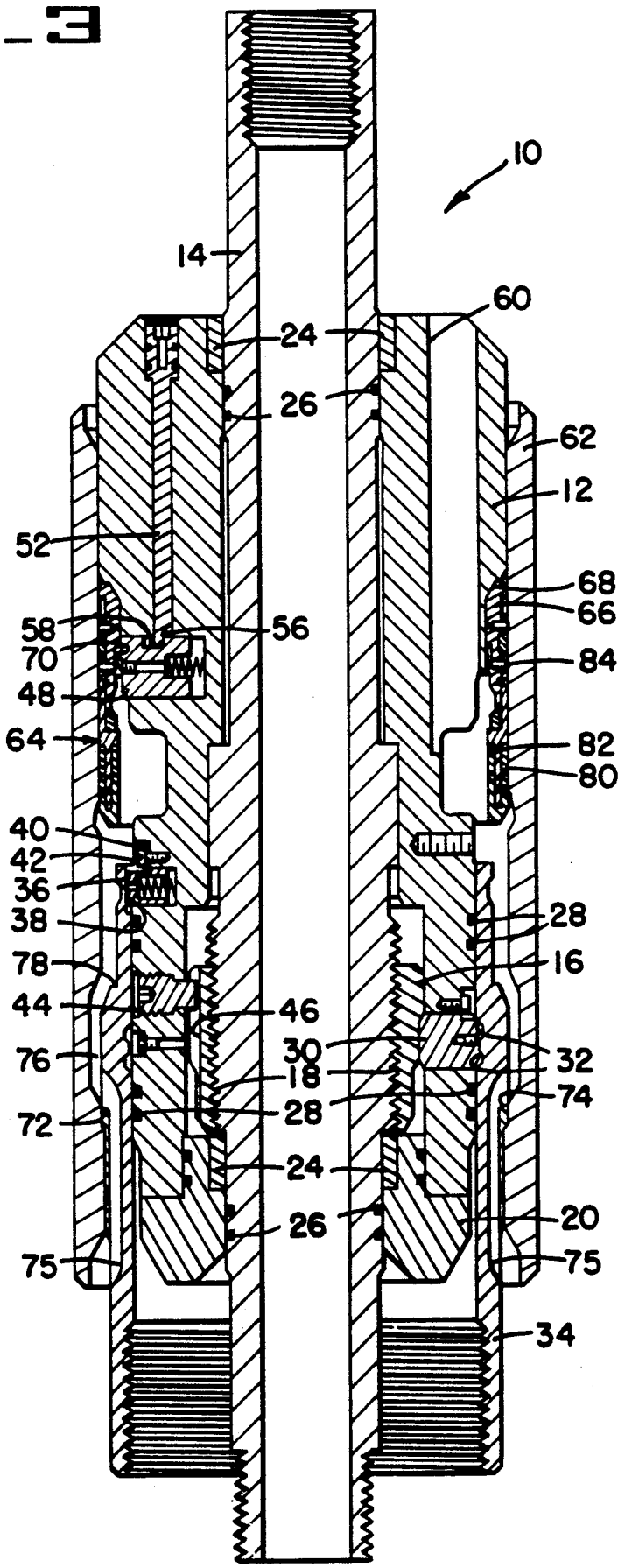
FIG. 3 is a vertical section through the tool along the line 3—3 of FIG. 2, showing the tool with a packoff and a casing hanger inside a surrounding wellhead housing adapter, and the hanger landed on the adapter seat.
Figure 4:
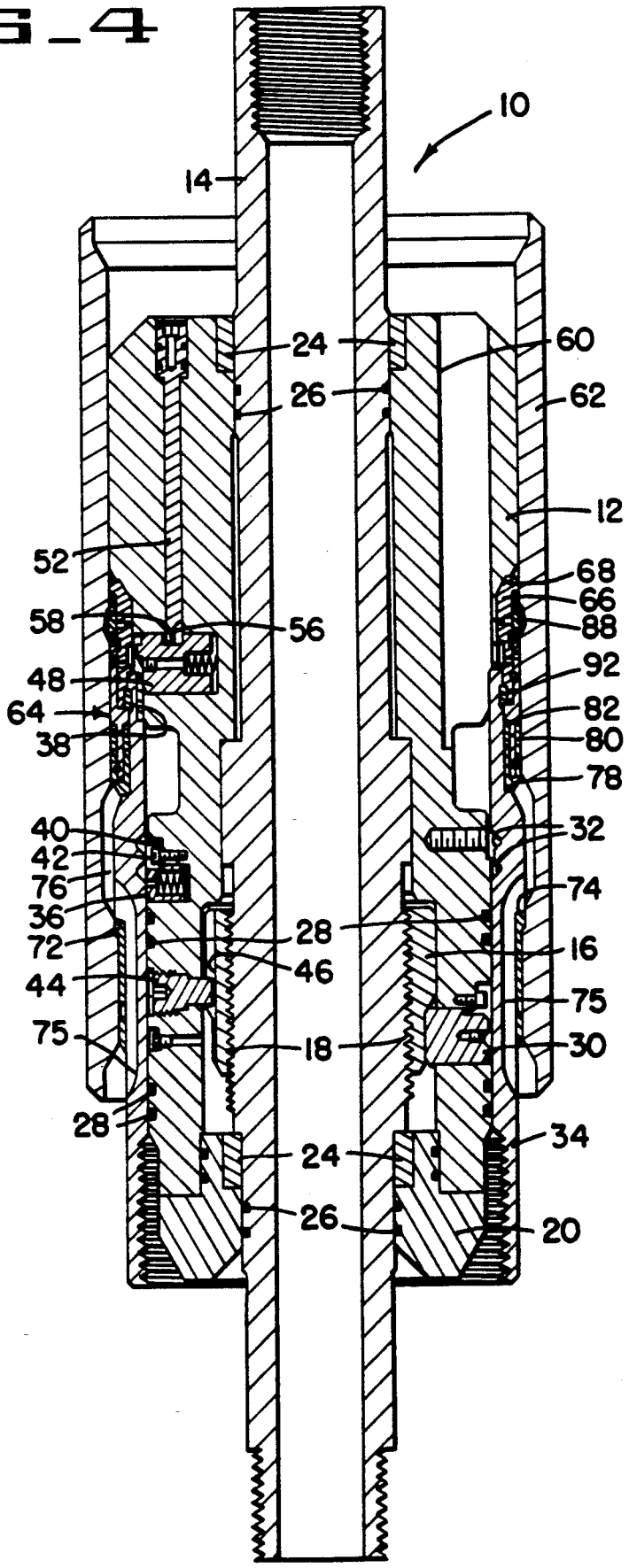
FIG. 4 is a view like FIG. 3, but showing the packoff landed and set in the annulus between the hanger and adapter.

The running tool 10 further includes a plurality (preferably six) of circumferentially spaced locking dogs 30 (only one shown) that reside in ports in the tool body 12, these dogs being movable, in response to downward movement of the actuation sleeve 16, from their retracted position shown in FIG. 1 into their functional position shown in FIG. 3 wherein they cooperate with internal grooves 32 on a casing hanger 34 to releasably lock the hanger to the tool. The tool 10 has a plurality (preferably two) of anti-rotation pins 36 (only one shown) circumferentially spaced on the tool body 12, which pins 36 are spring-biased outwardly to engage longitudinal slots 38 in the hanger 34 (FIG. 3) to prevent relative rotation between the tool body and the hanger, and each pin 36 is retained in the tool body by a washer 40 and a cap screw 42. The tool also includes an anti-rotation pin 44 that cooperates with a longitudinal groove 46 in the outer surface of the actuation sleeve 16 to prevent relative rotation between the sleeve and the tool body 12.

In the upper portion of the tool body 12 are a plurality (preferably four)of circumferentially spaced packoff running pins 48, and a like quantity of packoff retrieval pins 50 also circumferentially spaced about the tool body 12. The pins 48, 50 are spring-biased towards their extended position (FIGS. 3, 4, 6 and 7), and are retractable into the hanger body by rotation of retraction shafts 52, 54. The lower end of each shaft 52, 54 has a cam surface 56 that cooperates with an L-shaped slot 58 in the top surface of each pin 48, 50 to retract the pins as the shafts are rotated by a hex-wrench or other suitable tool during preparation of the running tool for running or retrieving a packoff. The upper portion of the tool body 12 also contains a plurality (preferably four) of circumferentially spaced flowby ports 60 for conducting fluid returns during cementing operations.

Running Procedures

The procedure for running a casing hanger and a packoff into a subsea wellhead housing or housing adapter, such as the adapter 62 illustrated in FIGS. 3–7, is as follows. The retraction shafts 52 are rotated as necessary to free the packoff running pins 48 which pins then are spring-urged into their extended position (FIG. 3), and the retraction shafts 52 are rotated to retract the packoff retrieval pins 50. The packoff assembly 64 is then slipped up over the running tool until the locking mandrel 66 of the packoff assembly stops against an annular shoulder 68 on the tool body 12, whereby the pins 48 snap out into an inner annular groove 70 on the mandrel 66, thereby locking the assembly 64 to the tool 10.

With the actuation sleeve 16 in its upper position as illustrated in FIG. 1, and thus the locking dogs 30 retracted as shown, the tool 10 is inserted into the casing hanger 34 until the dogs 30 are opposite the hanger grooves 32 and the anti-rotation pins 36 are engaged in the hanger slots 38. The tool mandrel 14 is then rotated to the left, causing downward movement of the actuation sleeve 16 into its lower position as shown in FIG. 3. As the sleeve 16 moves downward it forces the locking dogs 30 outward into the hanger grooves 32, thereby locking the tool to the hanger 34.

With the packoff assembly 64 and the casing hanger 34 locked to the running tool, this assembly is then lowered as a unit on a pipe string (not shown) through the drilling riser (not shown), BOP stack (not shown) and other wellhead components until the hanger's annular shoulder 72 lands on an annular seat 74 in the housing adapter 62.

Cementing operations are then carried out, during which the returns flow up the casing annulus (not shown), then into and through a plurality of longitudinal slots 75 in the hanger 34, up the annulus 76 between the hanger and the housing adapter 62, and finally through the flowby ports 60 in the upper portion of the tool body 12.

Once cementing operations are complete the running tool 10 is unlocked from the hanger 34 by right hand rotation of the pipe string and thus the tool mandrel 14 which is connected thereto. This rotation causes the actuation sleeve 16 to rise into its upper position shown in FIG. 1, thereby releasing the locking dogs 30 for inward movement into their retracted position, also as seen in FIG. 1, wherein the tool will be unlocked from the hanger.

The weight of the pipe string is then allowed to bear on the running tool 10, whereby the string, the tool and the packoff assembly 64 move downward until the packoff assembly lands on an annular shoulder 78 on the outer surface of the casing hanger 34. The weight of the pipe string and running tool then compresses the packoff's annular elastomeric seals 80, 82, sufficiently to form a low pressure seal in the annulus 76.

The BOP pipe ram (not shown) is then closed around the pipe string above the tool 10, and pressure is applied below the ram. This results in a large downward force on the tool, causing it to move downward until it lands on top of the casing hanger 34 (FIG. 4). As this downward movement occurs the packoff locking mandrel 66 moves downward, shearing the pins 84 between the mandrel and the body 86 and forcing the packoff-to-adapter lockdown ring 88 and the packoff-to-hanger lockdown ring 92 into their grooves 90, 93, respectively, thereby locking the packoff rigidly to the hanger and fully energizing the seals 80, 82 (FIG. 4).

Figure 5:
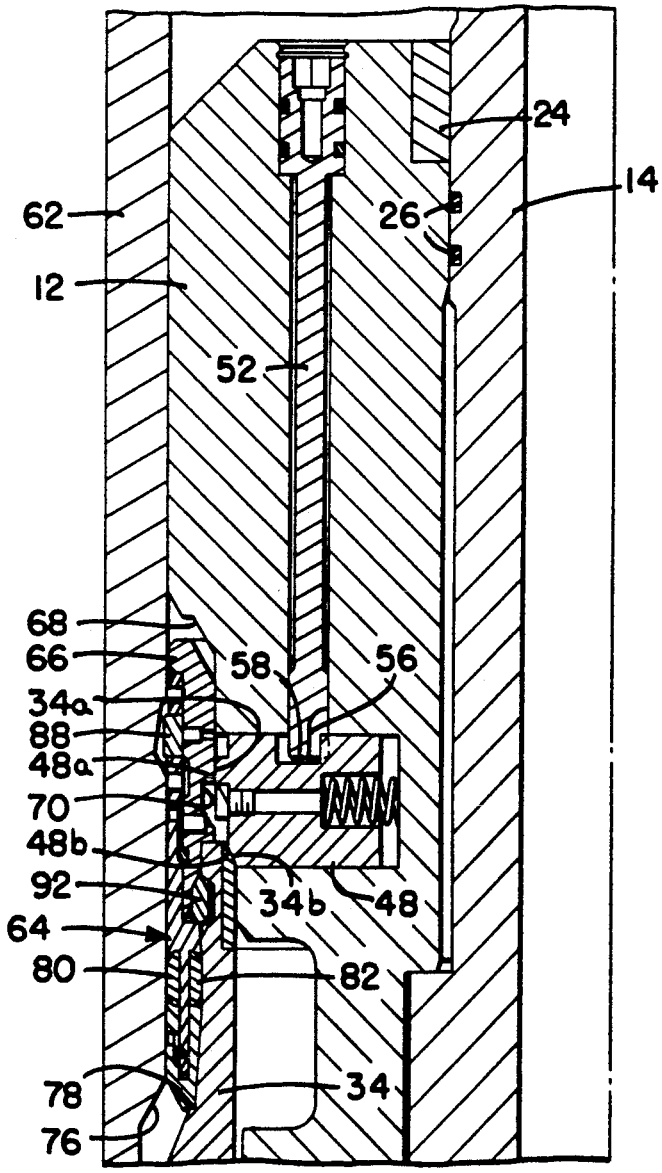
FIG. 5 is an enlarged fragmentary view of the upper left portion of FIG. 4, showing the tool partially lifted from the packoff during retrieval.

The running tool is then retrieved by a straight-up pull on the pipe string. The packoff running pins 48, which are disengaged when the tool is landed, will snap back out but, as shown in FIG. 5, are prevented from extending into the packoff locking mandrel groove 70 by contact of their front surfaces 48*a* and 48*b* with the opposed surfaces 34*a*, 34*b* of the hanger 34. If, for some reason, the packoff locking mandrel 66 is not completely down the packoff running pins 48 never release from the packoff, whereby when the running tool 10 is retrieved the packoff assembly 64 is retrieved with it, thereby preventing the packoff assembly from being left downhole in an unlocked condition.

As mentioned above, if desired the casing hanger 34 can be run, cemented, and the running tool 10 then released from the hanger and retrieved, and the packoff assembly 64 then run with the tool 10 on a second trip. The casing hanger locking dogs 30 must be in their unlocked position (FIG. 1) when the packoff is run separately so that the bottom of the tool 10 will stab back into the previously run hanger. Once the tool 10 stabs into the hanger the packoff is set in the same manner as in a single-trip procedure.

Packoff Retrieval Procedure

Figure 6:
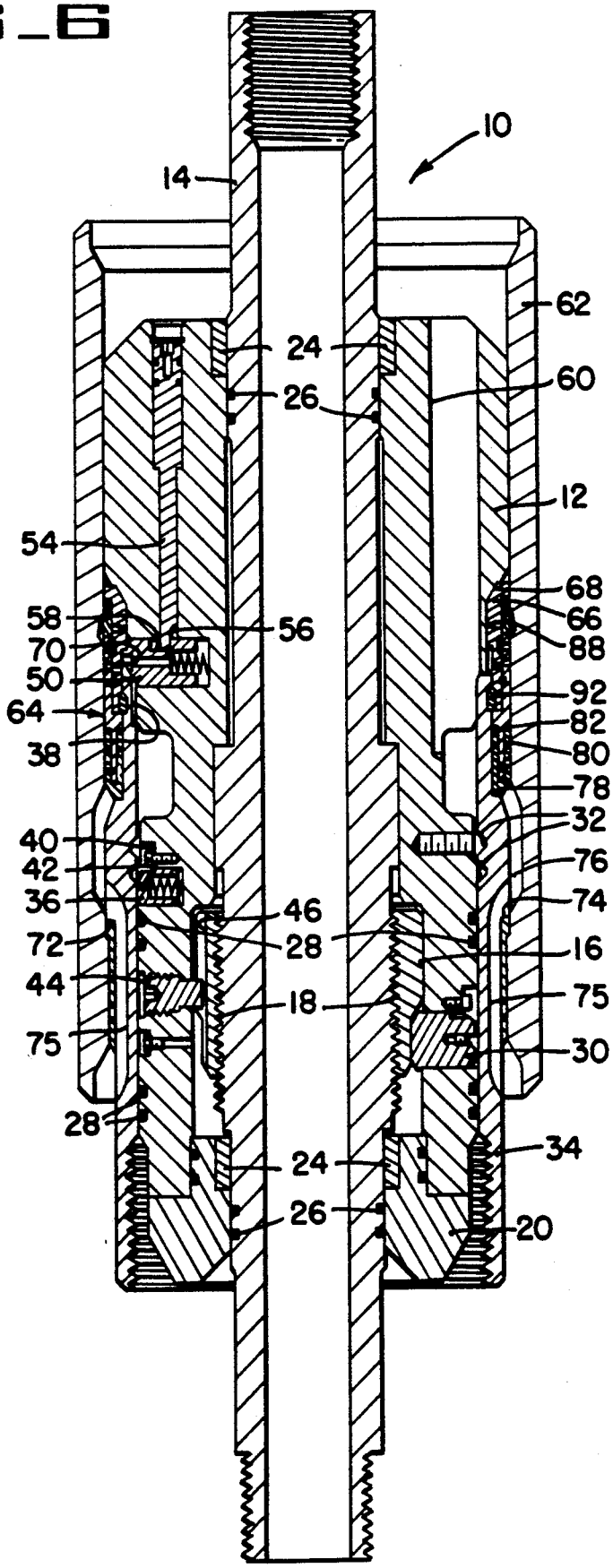
FIG. 6 is a vertical section through the tool along the line 6—6 of FIG. 2, showing the tool set up for packoff retrieval and connected to a packoff in a wellhead housing adapter.
Figure 7:
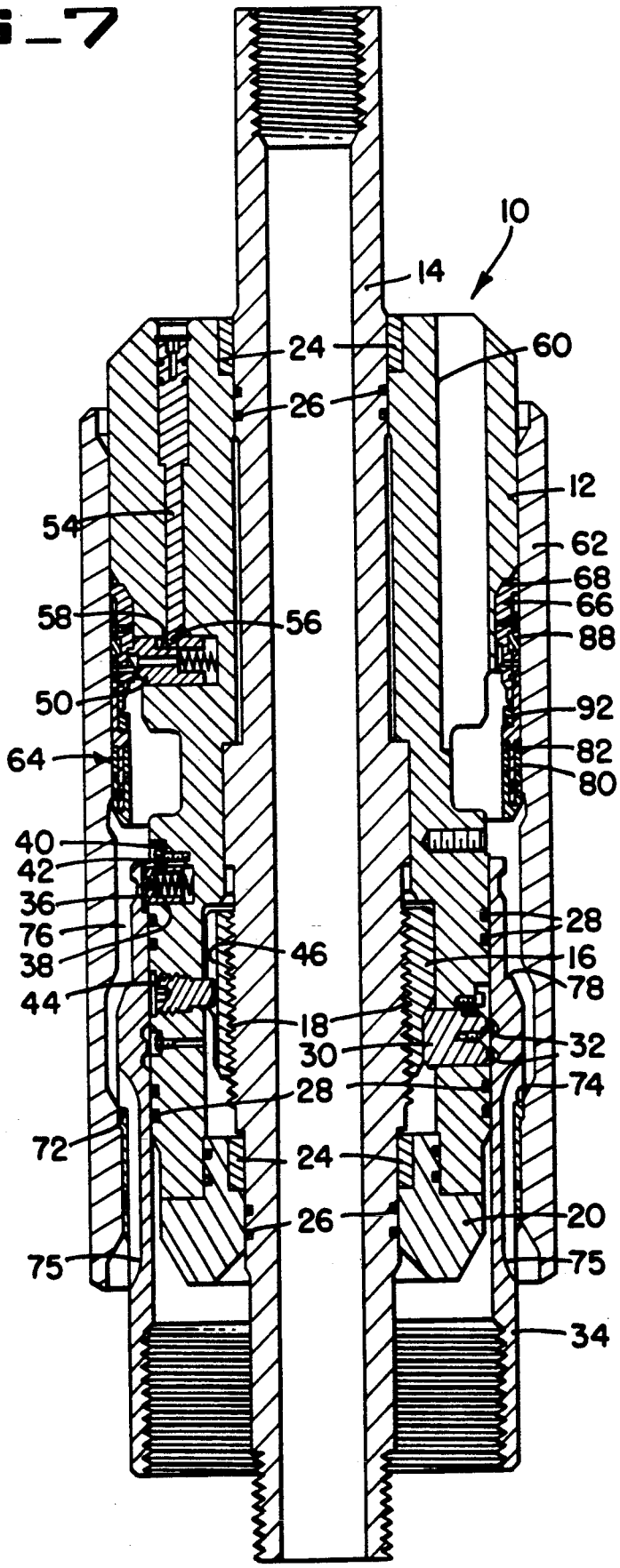
FIG. 7 is a view like FIG. 6, showing the tool and the packoff partially withdrawn from the housing adapter.

To prepare the running tool for retrieving a packoff, the casing hanger locking dogs 30 are placed in their retracted position (FIG. 1), the packoff running pins 48 are retracted (FIG. 1) by rotation of their retraction shafts 52, and the packoff retrieval pins 50 are released from their retracted position by appropriate rotation of their retraction shafts 54. The tool 10 is then lowered until its lower portion stabs into the casing hanger 34 and its upper portion lands on top of the hanger (FIG. 6). When the tool lands on the hanger the retrieval pins 50 snap out into the packoff locking mandrel groove 70.

The tool 10 is then pulled straight up, and as it moves upward it pulls the packoff locking mandrel 66 up. As the locking mandrel moves upward the packoff lockdown rings 88, 92 snap back out of their cooperating grooves, thereby unlocking the packoff from both the adapter 62 and the hanger 34. The entire packoff assembly 64 is then pulled out of the annulus between the adapter and hanger (FIG. 7) and carried up by the tool to the drilling rig floor.

Although the best mode contemplated for carrying out the present invention has been herein shown and described, it will be apparent that modification and variation may be made without departing from what is regarded to be the subject matter of the invention.

What is claimed is:

1. A well tool for running a casing hanger and a packoff into, and retrieving a packoff from, a subsea wellhead, said tool comprising an assembly of:

a) a tubular body including
   1) means to releasably connect a packoff to the body for running the packoff into a subsea wellhead;
   2) means to releasably connect a packoff to the body for retrieving the packoff from a subsea wellhead;
   3) means to relocate the packoff running means and the packoff retrieving means between their functional and non-functional positions;
   4) means to releasably connect a casing hanger to the body for running the hanger into a subsea wellhead;

b) a tubular mandrel surrounded by and rotatable with respect to the body;

c) means surrounding the mandrel for moving the casing hanger connection means into functional position;

d first anti-rotation means preventing relative rotation between the body and the means for moving the casing hanger connection means;

e) second anti-rotation means for preventing relative rotation between the body and a casing hanger connected thereto; and f) means for connecting the mandrel to a pipe string for running the tool into a subsea wellhead.

2. A well tool according to claim 1 wherein the connection means for running a packoff comprises a plurality of pins spring-biased for movement into functional position.

3. A well tool according to claim 2 wherein the means to relocate the packoff running pins comprises a plurality of rotatable retraction shafts extending between the pins and an externally accessible location on the body.

4. A well tool according to claim 3 wherein each shaft has a cam surface that cooperates with a pin surface to retract the pin into its non-functional position.

5. A well tool according to claim 1 wherein the connection means for retrieving a packoff comprises a plurality of pins spring-biased for movement into functional position.

6. A well tool according to claim 5 wherein the means to relocate the packoff retrieval pins comprises a plurality of rotatable retraction shafts extending between the pins and an externally accessible location on the body.

7. A well tool according to claim 6 wherein each shaft has a cam surface that cooperates with a pn surface to retract the pin into its non-functional position.

8. A well tool according to claim 1 wherein the connecting means for running the casing hanger comprises a plurality of locking dogs residing in ports in the body and movable into functional position in response to rotation of the mandrel.

9. A well tool according to claim 1 wherein the means for moving the hanger connection means comprises an actuation sleeve threaded onto the mandrel and movable longitudinally with respect to the body and the hanger connection means in response to rotation of the mandrel.

10. A well tool according to claim 9 wherein the sleeve includes a cam surface that cooperates with a surface on the hanger connection means to move said hanger connection means into functional position.

* * * * *